US008590230B2

(12) United States Patent
Stücklin et al.

(10) Patent No.: US 8,590,230 B2
(45) Date of Patent: Nov. 26, 2013

(54) PRESTRESSED SLAB ELEMENT

(75) Inventors: Michael Stücklin, Zurich (CH); Dejan Krecov, Wettswil (CH)

(73) Assignee: Cobiax Technologies AG, Zug (CH)

( * ) Notice: Subject to any disclaimer, the term of this patent is extended or adjusted under 35 U.S.C. 154(b) by 101 days.

(21) Appl. No.: 13/128,781

(22) PCT Filed: Oct. 26, 2009

(86) PCT No.: PCT/CH2009/000342

§ 371 (c)(1),
(2), (4) Date: Jul. 11, 2011

(87) PCT Pub. No.: WO2010/057322

PCT Pub. Date: May 27, 2010

(65) Prior Publication Data

US 2011/0258949 A1 Oct. 27, 2011

(30) Foreign Application Priority Data

Nov. 19, 2008 (EP) ..... 08405282

(51) Int. Cl.
*E04C 5/08* (2006.01)

(52) U.S. Cl.
USPC ..... 52/223.6; 52/223.1; 52/223.7

(58) Field of Classification Search
USPC ..... 52/223.6, 223.1, 223.7
See application file for complete search history.

(56) References Cited

U.S. PATENT DOCUMENTS 4,495,744 A * 1/1985 Carl ..... 52/576
4,702,048 A * 10/1987 Millman ..... 404/34

(Continued)

FOREIGN PATENT DOCUMENTS

AU 505 760 B2 1/1978
WO WO2005080704 * 9/2005
WO WO 2007/137318 A1 12/2007

OTHER PUBLICATIONS

International Preliminary Report on Patentability for International Application No. PCT/CH2009/000342, completed Feb. 14, 2011.

(Continued)

*Primary Examiner* — Mark Wendell
(74) *Attorney, Agent, or Firm* — Alston & Bird LLP

(57) ABSTRACT

The invention relates to a prestressed slab element (10), in particular a concrete slab element, manufactured according to the in-situ concrete method or prefabricated in a concrete precasting plant which in top view of its surface (11) comprises at least one hollow element region (20) with hollow elements (21) contained therein and at least one support region (30) for supporting or holding the slab element (10) without hollow elements (21), as well as stressing elements (40) for reinforcing the slab element (10), which each are installed through the slab element (10) and form a lattice-shaped structure (50), wherein individual fields (51) of this structure (50) establish a support or hollow element region (20, 30), and laterally adjoining fields (51) of the lattice-shaped structure (50) form at least one longish support strip (60) which joins individual support regions (30) with one another and which is embodied in a reinforced manner, characterized by stressing elements (40), which in a lateral view of the slab element (10) are installed in the slab element (10) wave-like and which support themselves on at least one lattice system (90) of bars (91) with hollow elements (21) held therein whose respective height is adapted to the wave shape.

20 Claims, 5 Drawing Sheets

(56) References Cited

U.S. PATENT DOCUMENTS

Figure 1:
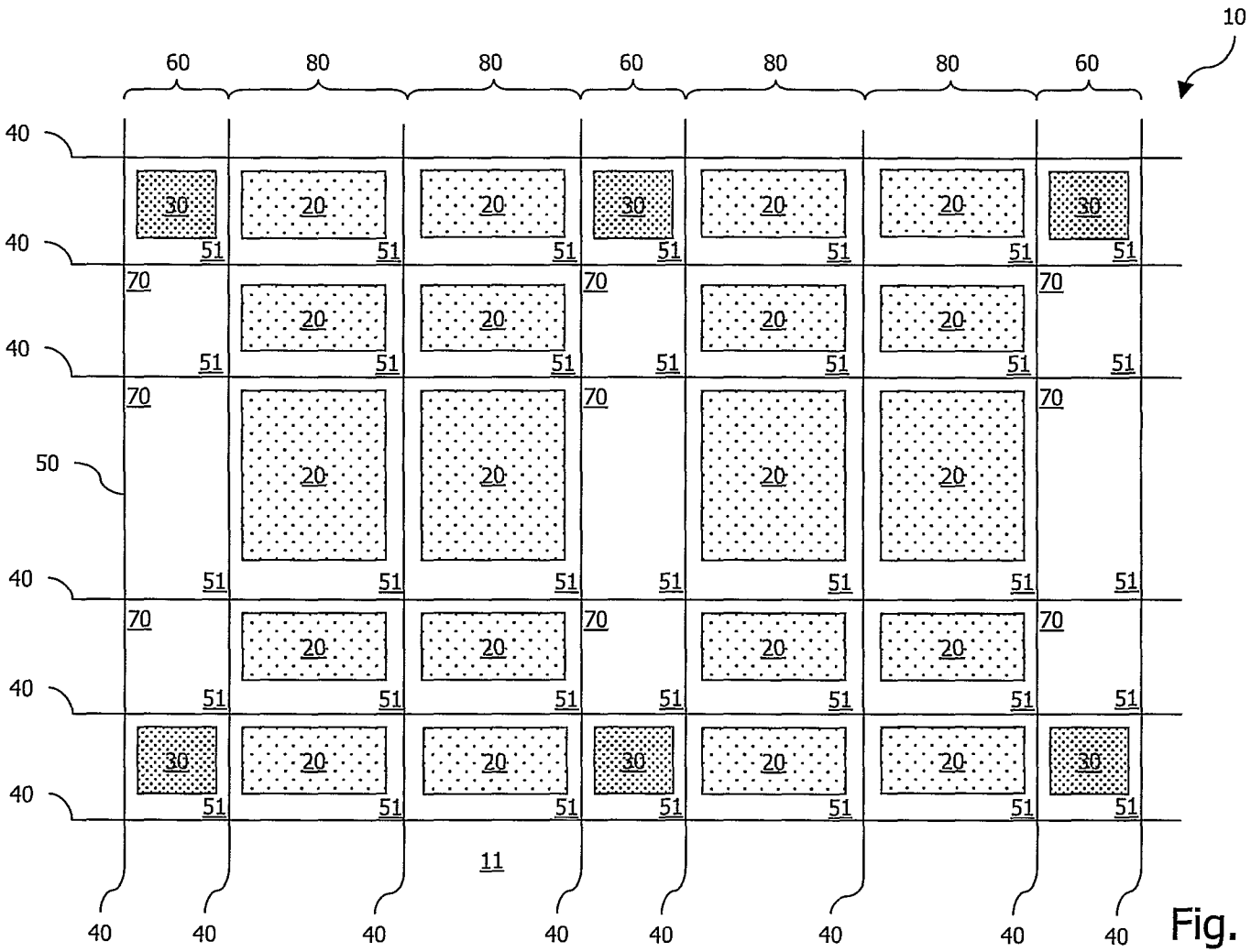

| | | | | |
|---|---|---|---|---|
| 5,396,747 | A * | 3/1995 | Breuning | 52/516 |
| 5,797,230 | A * | 8/1998 | Lassen | 52/323 |
| 7,540,121 | B2 * | 6/2009 | Haeussler | 52/323 |
| 7,897,073 | B2 * | 3/2011 | Haag et al. | 264/35 |
| 8,028,485 | B2 * | 10/2011 | Pfeffer et al. | 52/576 |

OTHER PUBLICATIONS

Pech Anton, et al.; "Decken (Baukonstruktionen—Band 5)" (English translation of title: "Ceilings (Building Structures—vol. 5)"; 2006, Springer-Verlag, Wien , XP002566861; ISBN: 3211252509 , pp. 29-32, 40; figures 050.2-21, 050.2-32.

* cited by examiner

PRESTRESSED SLAB ELEMENT

CROSS REFERENCE TO RELATED APPLICATIONS

This application is a national stage application filed under 35 U.S.C. 371 of International Application No. PCT/CH2009/000342, filed Oct. 26, 2009, which claims priority from European Application No. 08405282.8, filed Nov. 19, 2008, both of which are hereby incorporated herein in their entirety by reference.

The invention relates to a prestressed slab element according to the preamble of claim 1 and a preferred use of such a slab element according to claim 14 and a manufacturing method for a slab element according to claim 15.

It is already known to produce particularly slim slab elements of concrete and thus more preferably flat ceiling constructions based on hollow elements embedded therein. The slab elements specified therein are so-called "unstressed reinforced" elements whose reinforcement consists of orthogonally arranged reinforcing bars which absorb the tensile forces that develop in the concrete. The structural efficiency of this light construction technology allows for example the construction of slim yet wide-spanned flat ceiling constructions with simultaneous resource efficiency. Dependent on the diameter and the geometry of the hollow elements the embodiment of ceiling thicknesses from approximately 20 cm is possible.

With so-called "prestressed" slab elements however additional stressing elements such as cables are installed which are stressed after the hardening of the concrete. Because of this it is possible to create additional forces which can offset the loads created by the deadweight up to a certain degree. Depending on the geometric arrangement of the cables only a compressive force is created through the prestressing, that is the cables lie parallel to the ceiling plane or additionally a deflection force acting perpendicularly to the ceiling plane, in the case of a parabolic or trapezium-shaped or so-called "free position" of the cables. The deflection force created through the prestressing varies in practice between 80% and 100% of the ceiling deadweight. Depending on the building standard it is also possible in addition to the deadweight to additionally offset the live load acting on the ceiling through the deflection forces of the tensioning cables.

Thus, prestressed slab elements also include tensioning elements in addition to the "unstressed" reinforcing bars. In an extreme case, the addition of "unstressed" reinforcement can be reduced to a design minimum for example to accommodate parasitic, locally occurring constraining forces and as reinforcement against surface cracks when the deadweight and the live load of the element are completely offset through the deflection forces.

Devices necessary for the prestressing are tensioning cables, sleeves, which surround the cables, injection materials, which are introduced between sleeve and cable after the tensioning depending on the installation method, anchor heads, couplings, support aids for the sleeves and cables and tensioning devices.

The mass of ceiling deadweight to be offset through the deflection forces of the tensioning cables is directly proportional to the applied tensile force and consequently to the cross section of tensioning cables employed.

The tensioning cables consist of high-strength steel which has a particularly high tensile strength. The manufacture of the cables is therefore subject to stringent qualitative specifications as a result of which the costs of the cables are many times higher than the costs for conventional "unstressed" reinforcing steel.

At the edges of the ceiling the stressing cables are set in anchor heads which discharge the cable stresses into the concrete. Each stressing cable requires its own anchor heads on both opposite edges of the ceiling. These anchor heads additionally drive up the costs.

The use of prestressing allows the bridging of larger spans with the simultaneous minimisation of the ceiling thickness and thus the ceiling deadweight. In addition, prestressing allows better control of crack formation in the concrete through the horizontal tying-together. A further advantage of prestressing are the minimised deformations of the ceiling which with dimensioning of concrete ceilings frequently is the decisive criterion for the ceiling thickness. By employing prestressing the construction time can be additionally optimised since the shuttering of a prestressed ceiling can be removed earlier.

A further increase of the efficiency of unstressed reinforced or prestressed slab elements however does not appear possible to date.

The publication AU 505 760 B2 discloses components of a slab element which have a region that is hollowed out towards the bottom and can be prefabricated of concrete. These components are then arranged relative to one another on site and fastened. To this end, stressing elements are used which run along the lateral edges of the respective components.

The publication DE 12 22 643 B discloses a slab element which is prefabricated in a concrete plant. The slab element in top view of its surface contains at least one hollow element region with hollow elements contained therein. Stressing elements or reinforcing mats are cast into the bottom and top ceiling which run in two directions at a right angle to one another.

It is the object of the present invention to provide an improved slab element which can be manufactured carefully in terms of the material, light in weight and capable of carrying load as well as cost effectively.

This object is solved through a slab element and more preferably through a ceiling element according to claim 1.

In the context of this application the term "lattice-shaped" arrangement of stressing elements is to mean a structure wherein these elements cross one another at an angle or various angles that need not necessarily be right angles. The stressing elements need neither run in a straight line but more preferably with geometrically sophisticated slab geometries can also be installed curved, e.g. arc of a circle-shaped, parabolically, orthogonally or similar in order to satisfy the relevant load case.

The invention is based on that stressing elements passed over hollow element regions allow only limited prestressing because of the reduced material. In addition, a geometrical problem arises since the space to accommodate these elements is greatly restricted. Thus, if installation was at all possible in the past, the combination of hollow element regions and prestressing did not necessarily result in improved efficiency of the slab element. Excessive prestressing in these regions can even damage the slab element and thus render it unusable.

An essential point of the present invention initially consists in the specially reinforced support strips which join the individual support regions of the slab element with one another. This makes possible a hybrid combination of hollow element regions and prestressed regions of a slab element, which increases the optimising effect of both reinforcements in a technical, economical and ecological manner.

The approach of employing entire modules with hollow elements to reduce ceiling deadweight known from the "unstressed reinforced" flat ceilings can also be applied to prestressed ceilings wherein either only the deadweight or the entire loads are offset through stressing cables. Here, the technical advantages of both methods can be combined and the deadweight reduction of the ceiling compared with unstressed-reinforced concrete ceilings of solid design or prestressed ceilings further increased. The loads acting on the vertical elements such as supports, walls and foundations of a carrying structure are thus reduced even further. At the same time, the use of material in terms of stressing cables and anchor heads is optimised, more so since the deadweight of the ceiling additionally reduced by between 25% and 30% has a directly proportional influence on the required stressing cable cross section. In addition, the concrete volume required is reduced and the deformation of the ceiling additionally minimised.

Depending on the ceiling outline and support grid a planner has various possibilities of arranging the cables. He can, for example, select areal prestressing during which the cables are arranged evenly distributed over the ceiling length and width. Another option is offered by the support strip prestressing, wherein the cables are arranged in a concentrated manner in the zones passing over the supports in strips arranged orthogonally relative to one another. However, a combination of both arrangements can also be selected wherein one direction is worked areally, the other using support strips.

A further reinforcement of the slab element is achieved in that in its lateral view the stressing elements are installed in the slab element wave-like and support themselves on at least one lattice system of bars with hollow elements held therein, whose respective height is adapted to the wave shape. Since the lattice system discharges the forces introduced from the stressing element past the hollow spaces these are protected against destruction. This allows hitherto unknown stressing element guidance and thus prestressing even across hollow element regions. Preferred further developments of the slab element according to the invention are stated in the subclaims and relate to reinforcing types of the element with areal, support strip and combined prestressing.

In the event of areal prestressing a support strip preferentially comprises at least one solid material region via which the introduced loads can be discharged. However, in order to nevertheless obtain a particularly lightweight construction it is preferred that laterally adjoining fields of the lattice-shaped structure at least form 1 longish carrying strip with hollow element regions which is arranged between two support strips.

In the case of support strip prestressing however additional stressing elements are preferentially arranged in longitudinal direction of a support strip to reinforce the slab element. These stressing elements need not necessarily run laterally off the strip. They can more preferably be arranged distributed over its width or be located only in its middle region. These additional stressing elements can also be configured comparatively thicker than others.

Alternatively or additionally the stressing elements which run in longitudinal direction of a support strip can themselves be reinforced, e.g. have a larger cross section or a material of greater tensile strength than the other stressing elements. To reduce weight, a support strip can comprise at least one hollow element region.

In the case of combined areal and support strip prestressing additional stressing elements of solid material can for example be provided within a support strip while another support strip is only reinforced laterally and comprises hollow element regions. To further reinforce the support strip, additional stressing elements can be provided which are distributed over its width or only run in its middle. If these stressing elements engage over hollow element regions of the support strip these are provided with reduced prestressing. Weight reduction of the slab element can be achieved through carrying strips which run in lattice structure between the support strips.

In each of the cases a slab element is obtained which is particularly simple in construction and can be unidirectionally loaded if its lattice-shaped structure forms a grid of rectangular fields. Dependent on the case of application, any other structure consisting of stressing elements running in a straight line or curved line can also be provided, which cross at a certain or a plurality of different angles.

It is preferred if the rods of the lattice systems relative to a normal of the surface of the slab element are arranged with a slightly oblique orientation. Modules designed in such a manner thus offset local reduction of the transverse force load carrying capacity of the slab cross section caused through the hollow elements. In addition, these lattice bars can absorb the local parasitic stresses vertically to the ceiling plane generated in the concrete through the prestressing if applicable.

Also in the zones covered by the stressing cables, where the cables in the lower region of the ceiling cross section run parallel to the ceiling plane, additional modules can be installed if required. To this end, these are positioned by means of a spacer at a suitable spacing to the stressing cables and above these, dependent on the standards and the manufacturer's details for the minimal concrete sheathing of the cables. However, the hollow element diameter that can be employed is reduced if applicable.

Lateral strips of the hollow element regions can still be reinforced in that the lattice system comprises support bars which in longitudinal direction protrude over a receiving region for hollow elements and over which the stressing elements are installed. The lateral support can be further improved in that individual lattice systems of bars with hollow elements held therein are so arranged relative to one another that their support bars on both sides mutually overlap one another. At the same time, reinforcement which in longitudinal direction runs over at least two lattice systems is created.

Dependent on structural specifications it can however be preferred that lattice systems comprise receiving regions which do not contain any hollow elements and over which the stressing elements are installed. As a result, an extremely flexible reinforcement of the slab element even over regions containing hollow elements but despite existing areal or support strip prestressing require additional reinforcement is possible.

Preferably the slab element according to the invention is to be used as ceiling element since especially loads occurring there require low weight and large load carrying capacity of the ceiling construction. However, its use is not only limited to this since it can also be utilised in any other form of application where particularly lightweight and yet particularly sturdy elements are demanded at the same time. This is not only the case in residential and commercial construction but also includes more preferably power plants, bridges, dams etc.

The aforementioned object is solved also through a method for producing a slab element according to claim 15.

A substantial point of the method according to the invention herein consists in its simple executability both in the classic in-situ concrete application and also with prefabricated elements manufactured in a concrete precasting plant.

The application of this method is conceivable both for use with concrete of conventional composition and quality as well as for concrete of alternative mixture and concept such as lightweight concrete and fibre concrete. Lattice systems with hollow elements contained therein are preferably supplied as modules.

These modules are directly installed in the zones of the ceiling not occupied by the stressing cables between the lower and upper unstressed reinforcement. If in the zones occupied by the modules no unstressed reinforcement is provided the modules are directly placed onto the spacers which rest on the shuttering. This is advantageous insofar as the ceiling cross section through the absence of the upper and/or lower unstressed reinforcing layers can be better utilised in favour of the modules. Taking into account the required minimum lower and upper concrete coverage of the modules, larger hollow elements can be employed as a result.

With areal or support strip prestressing stressing elements can additionally reinforce the slab element which run over hollow element regions. Here, these elements need not have the basic stress of the areal or the support strips but can be prestressed to a lesser degree. Unstressed reinforcement is then no longer absolutely required so that a larger spacing between modules and surfaces of the slab element can be utilised to accommodate the stressing elements. Here, the modules can simultaneously serve as support aid for the prestressing cables. In such a case modules in stepped size are selected according to the geometrical course of the stressing cables and in the regions where the stressing cables are located in the upper region of the ceiling cross section, placed under the stressing cables. Because of this, additional areas can be covered with modules and the weight saving further optimised as well as conventional support aids saved. In addition, the geometry of the modules used here can still be adapted to the circumstances and specific requirements of the stressing cables if required. Preferably the at least one stressing element is placed on support bars of the lattice system which in longitudinal direction protrude over a receiving region for hollow elements. As a result, respective end regions of the lattice system can be additionally reinforced since no hollow elements will come to be positioned there any longer.

In an advantageous manner at least two lattice systems are so installed here that their respective support bars overlap one another. On the one hand this provides greater support for the stressing elements. In the case of ceilings, where unstressed reinforcement is entirely omitted or such is only locally installed in certain areas of the ceiling, or only a minimum of unstressed reinforcement is required, the presence of the modules has the effect that the lower and upper longitudinal bars of the modules can be considered as unstressed additional reinforcement. Because of this, the minimum additional reinforcement can be reduced at least in the reinforcement direction of the modules and the function of the crack reinforcement partially or completely assumed by the modules. However, for this to be possible it must be ensured that the protrusions of the longitudinal bars of the modules are extended by an overlap dimension defined by the standards and subsequently arranged in a superimposing manner. Because of this, the continuity of the reinforcement required by the standards is achieved.

Figure 2:
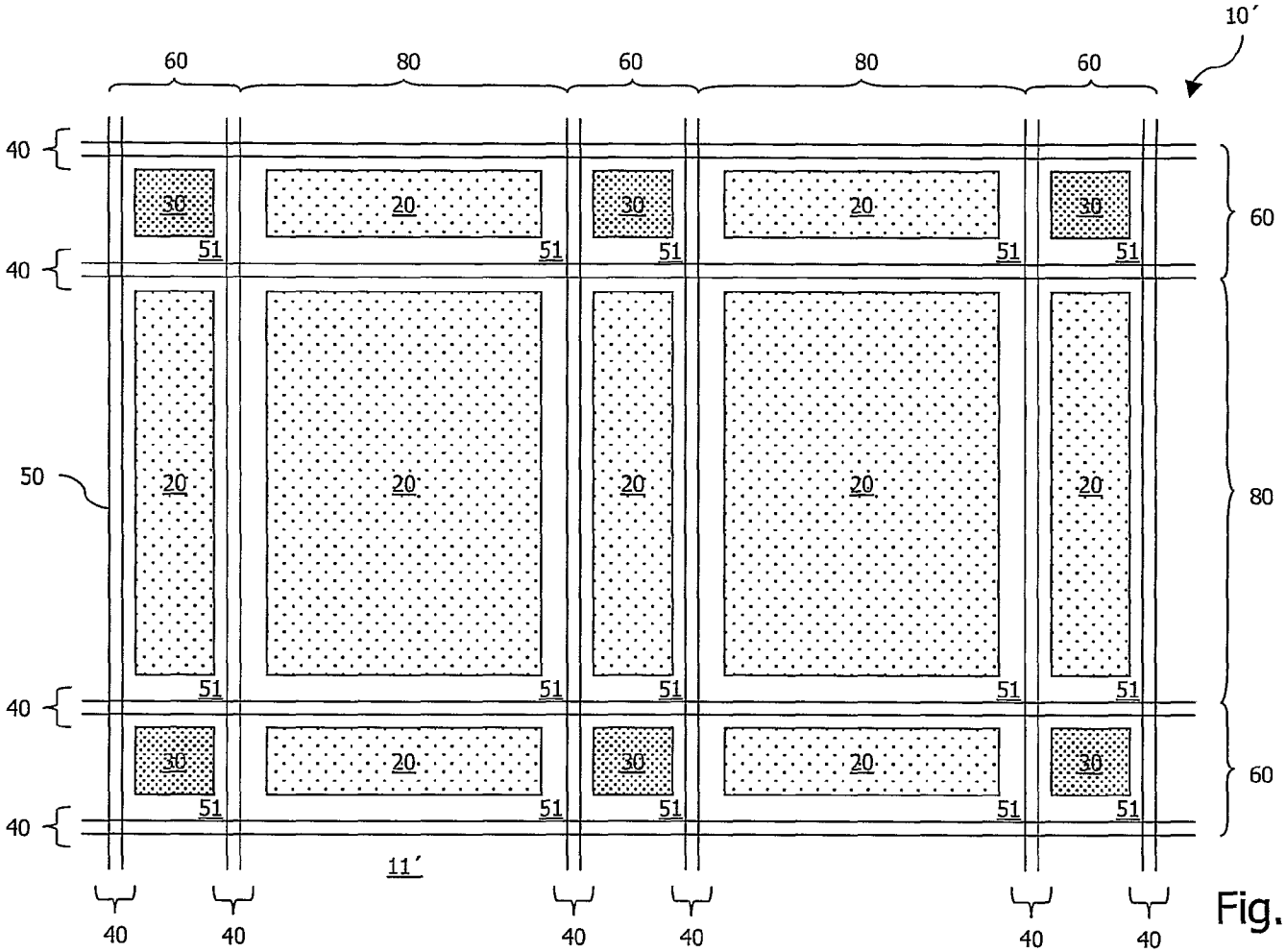
Figure 3:
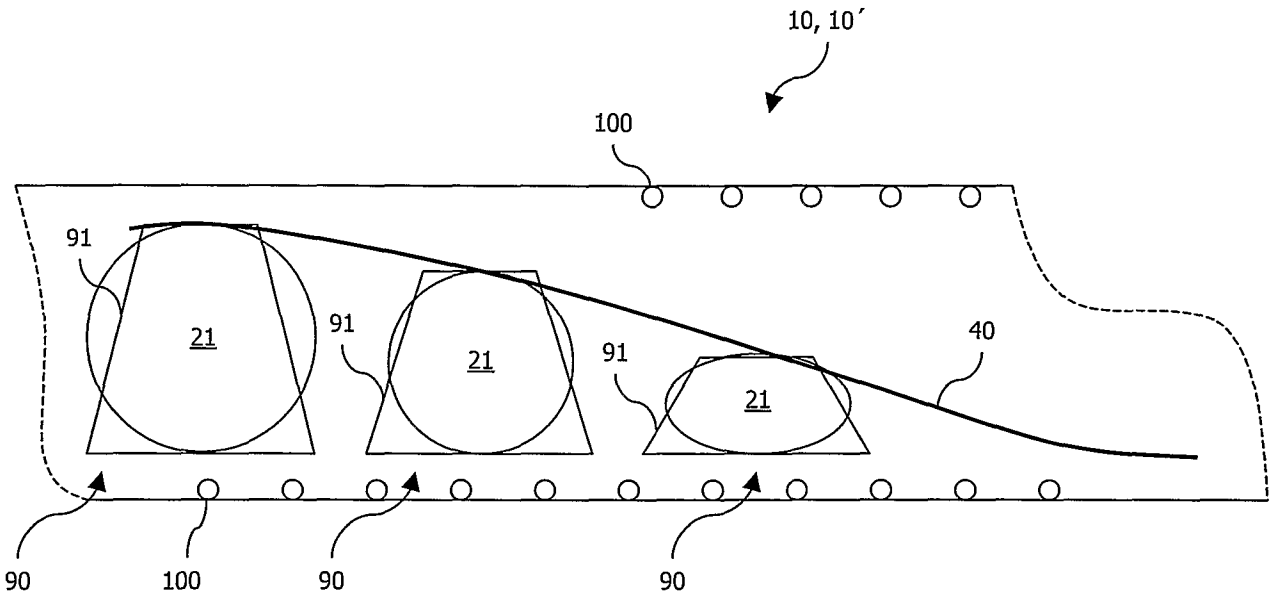
Figure 4:
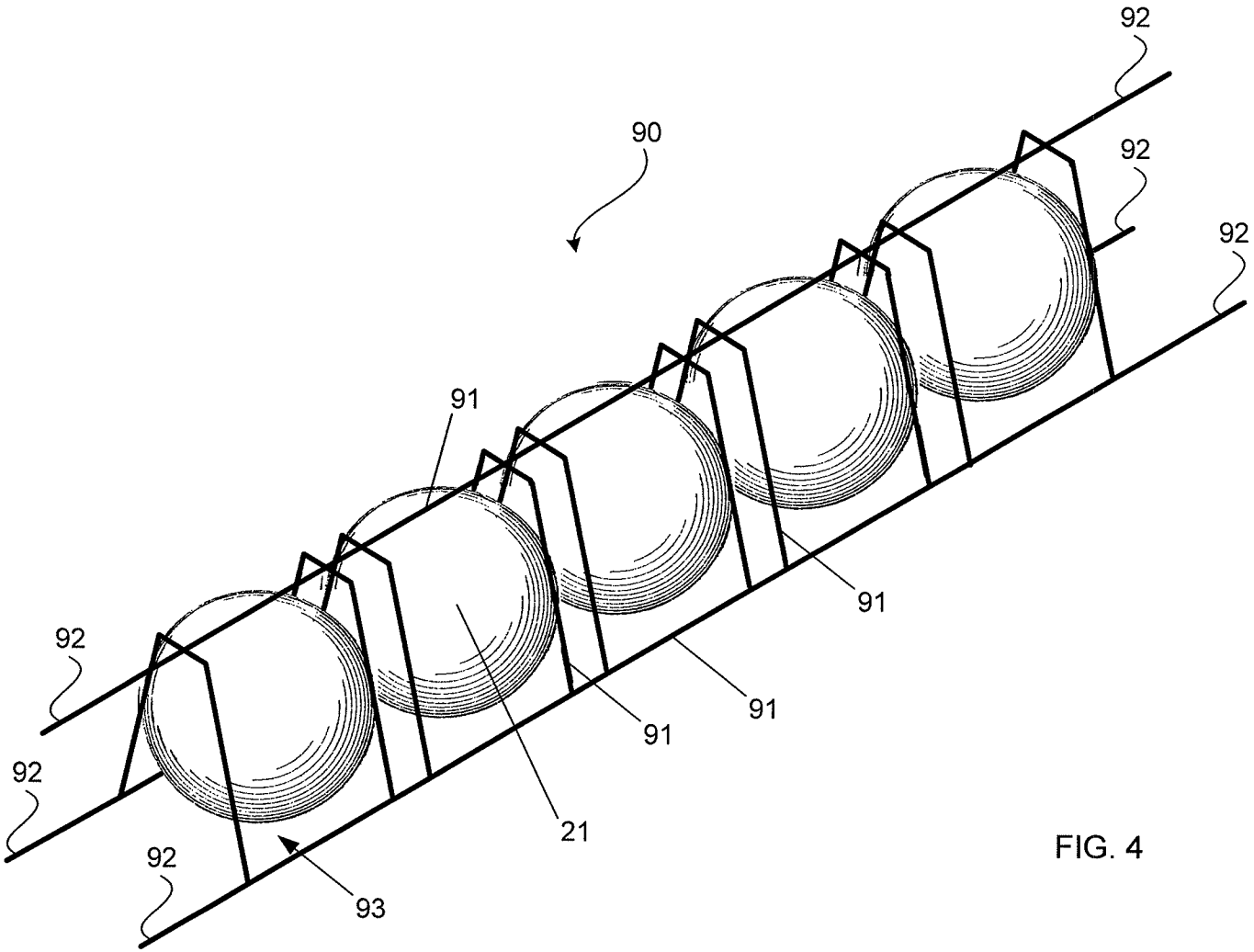
Figure 5:
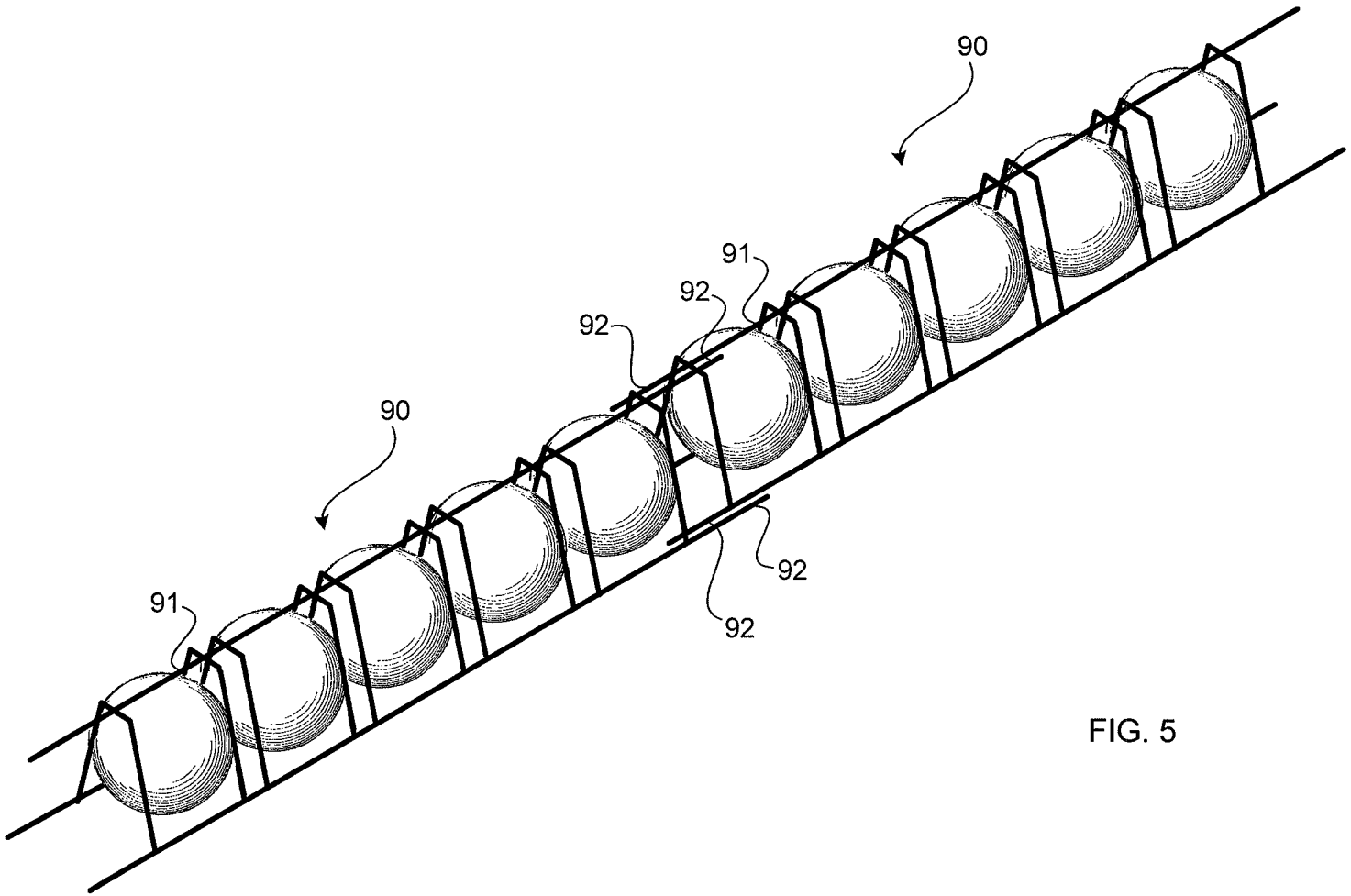

In the following, the invention is explained by means of examples wherein reference is made to the appended figures. Identical or identically acting parts are provided with identical reference figures. It shows:

FIG. 1 the schematic construction of a slab element according to the invention with areal prestressing in a top view of its surface;

FIG. 2 the schematic construction of a slab element according to the invention with support strip prestressing in a top view of its surface;

FIG. 3 a lateral view of the first and second slab element with a course of a stressing element over lattice systems with hollow elements held therein;

FIG. 4 a lattice system according to the invention with hollow elements held therein and protruding bars and FIG. 5 a combination of two lattice systems of FIG. 4 arranged in an overlapping manner about the protruding bars.

FIG. 1 shows the schematic construction of a slab element 10 according to the invention with areal prestressing in a top view of its surface 11. The element 10 in this case comprises hollow element regions 20 and support regions 30. In this example, orthogonally arranged stressing elements 40 form a lattice-shaped structure 50 whose respective fields 51 limit the regions 20 and 30. Laterally adjoining fields 51 form support strips 60 which connect the support regions 30 with one another over fields 51, wherein these fields are embodied as solid material regions for reinforcement of the support strip. Laterally adjoining fields 51 in contrast form rows of longish carrying strips 80 with hollow element regions 20 which are areally stressed via the stressing elements 40. Such a slab element 10 is preferably employed as ceiling element which is mounted in the support regions 30. In connection with the areal prestressing via the lattice system 50 the solid material support strips 60 provide adequate stability for the carrying strips 80 that run inbetween so that a ceiling element is created which is lightweight yet capable of carrying load at the same time. Through the right-angled installation of the stressing elements 40, simple and cost-effective manufacture of the element 10 is ensured at the same time.

FIG. 2 shows the schematic construction of a slab element 10' with support strip prestressing according to the invention in a top view of its surface 11'. The element 10' again comprises support and hollow element regions 20 and 30. Here, too, orthogonally orientated stressing elements 40 forms a lattice-shaped structure 50 whose fields 51 limit the regions 20 and 30. Along support strips 60, which run orthogonally relative to one another over the slab element 10', the stressing elements 40 however are reinforced, in this example of double design. However, for reinforcement, a larger cross section and/or a material of greater tensile strength of the stressing elements can be provided. The support strips 60 are thus reinforced in such a manner that these can also comprise hollow element regions which render the element 10' more lightweight. Through the reinforcement of the support strips 60, carrying strips 80 can be provided with large area hollow element regions 20 which run vertically and horizontally between the support strips 60. Although all fields 51 possible here are embodied with hollow element regions 20, not only a weight optimum but also a load-carrying capacity optimum is thus achieved with such an element 10'. Here, too, the right-angled installation of the stressing elements 40 makes possible the simple and cost-effective manufacture of the element 10'.

FIG. 3 shows a lateral view of the first and second slab element 10, 10' with a course of a stressing element 40 over lattice systems 90 with hollow elements 21 held therein. The size of the lattice systems 90 here is so selected that these determine the desired course of the stressing element 40. The lattice systems are constructed of bars 91 whose for example trapezium-shaped frame on the one hand brings about particularly high stability and on the other hand particularly high force discharge of the prestress of the stressing element 40 into the material. The stressing element 40 here rests on longitudinal bars 91 of the lattice systems 90 which run vertically to the blade plane. These bars 91 have a reinforcing effect which corresponds to that of a reinforcement 100 and can even replace the reinforcement 100 under the circumstances still to be described in the following. The combination of lattice systems 90 and stressing elements 40 makes possible prestressing in hollow element regions 20 of the slab elements 10, 10' of FIGS. 1 and 2 and thus reinforcement of the element 10, 10'.

FIG. 4 shows a lattice system 90 according to the invention with hollows 21 held therein and protruding bars 92 which protrude over receiving regions 93 for the hollow elements 21. The stressing element 40 only shown exemplarily in FIG. 3 can however be installed at any desired point over for example the uppermost longitudinal bar 91 of the lattice system 90. It is advantageous however to guide it over for example the uppermost support bar 92 of the lattice system 90 on the one or the other end of the lattice system 90 since these ends are filled with solid material which permits higher prestressing and thus reinforcement. Obviously it is also possible to remove individual hollow elements 21 from the lattice system 90 in order to create solid materials zones at this location or these locations in which specific reinforcement through particularly highly stressed elements 40 is provided.

FIG. 5 finally shows a combination of two lattice systems 90 of FIG. 4 arranged in a overlapping manner about the protruding bars 92. Because of this overlap, all longitudinal bars 91 of both lattice systems 90 act like the correspondingly orientated reinforcements 100 in FIG. 3. At the same time, the overlapping bars 92 provide a more stable support for the stressing cable 40 likewise shown there if it is installed over these bars 92.

Through the presented measures according to the invention, deliberate reinforcement of a wall element dependent on the planned use thus becomes possible. The slab element according to the invention has a clearly higher load-carrying capacity and is simultaneously lighter in weight than a known slab element. The simple construction allows cost-effective manufacture at the same time. Because of its efficiency it is to be preferably employed as ceiling element which carries over wide areas.

The invention claimed is:

1. A concrete slab element, comprising:

at least one hollow element region comprising hollow elements disposed therein;

at least two lattice systems retaining the hollow elements in the at least one hollow element region, wherein the at least two lattice systems comprise at least a first size lattice system configured to retain a first size of the hollow elements and a second size lattice system configured to retain a second size of the hollow elements, wherein the first size lattice system is higher than the second size lattice system, and wherein the first size hollow elements are higher than the second size hollow elements; and first stressing elements installed through the concrete slab element, supported across the lattice systems and hollow elements, wherein the respective varying heights of the first size lattice system with first size hollow elements and the second size lattice system with second size hollow elements are configured to support the first stressing elements in a wave-like shape in a lateral view of the concrete slab element.

2. The concrete slab element of claim 1, wherein the at least two lattice systems further comprise a third size lattice system configured to retain a third size of the hollow elements, wherein the third size lattice system is higher than the first size lattice system, wherein the third size hollow elements are higher than the third size hollow elements, and wherein the first stressing elements are further supported across the third size lattice system and the third size hollow elements to further define the wave-like shape of the first stressing elements.

3. The concrete slab element of claim 1, wherein the first hollow elements are spherical and the second hollow elements are ovoid.

4. The concrete slab element of claim 1, wherein bars of the lattice systems are arranged in an oblique manner relative to a normal of a top surface of the concrete slab element.

5. The concrete slab element of claim 1, wherein bars of the lattice systems are arranged in trapezium shapes.

6. The concrete slab element of claim 1, wherein the concrete slab element is a prestressed concrete slab element by stressing at least the first stressing elements supported across the lattice systems and hollow elements.

7. The concrete slab element of claim 1, further comprising second stressing elements arranged to cross the first stressing elements to form a lattice-shaped arrangement of stressing elements.

8. The concrete slab element of claim 7, wherein the concrete slab element is a prestressed concrete slab element by stressing the first stressing elements supported across the lattice systems and hollow elements and by stressing the second stressing elements.

9. The concrete slab element of claim 8, wherein the first stressing elements and the second stressing elements are stressed at different amounts of force.

10. The concrete slab element of claim 7, wherein the concrete slab element is a prestressed concrete slab element by stressing the second stressing elements, and, wherein the second stressing elements do not pass through hollow element regions.

11. The concrete slab element of claim 7, wherein the second stressing elements do not pass through hollow element regions.

12. The concrete slab element of claim 7, wherein the second stressing elements pass through only solid material regions.

13. The concrete slab element of claim 7, wherein the first stressing elements pass through only the hollow element regions and the second stressing elements pass through at least one of the hollow element regions and at least one solid material region.

14. The concrete slab element of claim 13, wherein the second stressing elements are distributed over a greater width than the first stressing elements.

15. The concrete slab element of claim 7, wherein the second stressing elements are distributed over a greater width than the first stressing elements.

16. A method of manufacturing a concrete slab element, comprising:

arranging at least two lattice systems, each comprising receiving regions configured to retain hollow elements, wherein the at least two lattice systems comprise at least a first size lattice system with receiving regions configured to retain a first size of the hollow elements and a second size lattice system with receiving regions configured to retain a second size of the hollow elements, wherein the first size lattice system is higher than the second size lattice system;

disposing hollow elements of the first size in a plurality of adjacent receiving regions of the first size lattice system and disposing hollow elements of the second size in a plurality of adjacent receiving regions of the second size lattice system, thereby defining a hollow element region comprising the hollow elements disposed in the first size lattice system and disposed in the second size lattice system, wherein the first size of hollow elements is higher than the second size of hollow elements;

arranging at least first stressing elements supported across the at least two lattice systems and hollow elements, wherein the respective varying heights of the first size lattice system with first size hollow elements and the second size lattice system with second size hollow elements support the first stressing elements in a wave-like shape in a lateral view of the concrete slab element.

17. The method of claim 16, further comprising:

introducing and initially hardening at least a first concrete layer; and stressing the first stressing elements for reinforcing the concrete slab element.

18. The method of claim 16, further comprising introducing and hardening a second concrete layer before stressing the first stressing elements, wherein the first concrete layer secures the hollow elements, and wherein the second concrete layer produces a final thickness of the concrete slab element.

19. A concrete slab element, comprising:

at least one hollow element region comprising hollow elements disposed therein;

at least one lattice systems retaining the hollow elements in the at least one hollow element region;

first stressing elements supported across the lattice systems and hollow elements; and second stressing elements arranged to cross the first stressing elements to form a lattice-shaped arrangement of stressing elements, wherein the concrete slab element is a prestressed concrete slab element by stressing the first stressing elements supported across the lattice systems and hollow elements and by stressing the second stressing elements, and wherein the second stressing elements are stressed at a greater amount of force than the first stressing elements are stressed.

20. The concrete slab element of claim 19, wherein the first stressing elements pass through only the hollow element regions and the second stressing elements pass through at least one of the hollow element regions and at least one solid material region.

* * * * *

UNITED STATES PATENT AND TRADEMARK OFFICE

CERTIFICATE OF CORRECTION

PATENT NO. : 8,590,230 B2
APPLICATION NO. : 13/128781
DATED : November 26, 2013
INVENTOR(S) : Stucklin et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 155 days.

Signed and Sealed this
Fourteenth Day of July, 2015

Michelle K. Lee

Michelle K. Lee
*Director of the United States Patent and Trademark Office*